US007371289B2

(12) United States Patent
Reinholdt et al.

(10) Patent No.: US 7,371,289 B2
(45) Date of Patent: May 13, 2008

(54) CLEANING AND DOPING OF TUBULARS

(75) Inventors: Bernd Reinholdt, Hannover (DE); Matthias Luecke, Hannover (DE)

(73) Assignee: Weatherford/Lamb, Inc., Houston, TX (US)

( * ) Notice: Subject to any disclaimer, the term of this patent is extended or adjusted under 35 U.S.C. 154(b) by 353 days.

(21) Appl. No.: 10/333,763

(22) PCT Filed: Jul. 12, 2001

(86) PCT No.: PCT/GB01/03132

§ 371 (c)(1),
(2), (4) Date: Aug. 29, 2003

(87) PCT Pub. No.: WO02/08564

PCT Pub. Date: Jan. 31, 2002

(65) Prior Publication Data

US 2004/0026080 A1 Feb. 12, 2004

(51) Int. Cl.
*B08B 3/00* (2006.01)

(52) U.S. Cl. ..... 134/26; 134/36; 134/37; 134/95.3; 166/77.51; 166/311; 166/377

(58) Field of Classification Search ..... 134/26, 134/36, 37, 95.3; 166/311, 377, 77.51
See application file for complete search history.

(56) References Cited

U.S. PATENT DOCUMENTS 5,157,802 A 10/1992 Guidry et al. ..... 15/88
5,857,476 A 1/1999 Bee et al. ..... 134/167 C

FOREIGN PATENT DOCUMENTS

| | | |
|---|---|---|
| EP | 0 338 222 A2 | 10/1989 |
| NL | 8800247 | 9/1989 |
| WO | 95/25216 | 9/1995 |
| WO | 99/60245 | 11/1999 |

OTHER PUBLICATIONS

Abstract NL8800247.*
International Search Report, dated Oct. 29, 2001 for PCT/GB01/03132.

* cited by examiner

*Primary Examiner*—Zeinab El-Arini
(74) *Attorney, Agent, or Firm*—Patterson & Sheridan, LLP

(57) ABSTRACT

Apparatus for cleaning and doping a pin 2 of a tubular 3 during the making or breaking of a string on a well platform. The apparatus comprises a housing 4 having first and second conosed ends 6,7 and arranged in used to be secured at its first end 7 to the well platform or to a movable arm. The second end 6 has an opening therein for receiving the pin 2 to be cleaned and doped. A nozzle array 16 is mounted within the housing 4 for rotation about a longitudinal axis of the housing 4 and is coupled to a source of lubricant. A washing and drying unit 10 is also mounted within the housing 4, axially displaced from said nozzle array 16 and coupled to a source of cleaning liquid and a source of drying gas.

35 Claims, 13 Drawing Sheets

3
11
12
16
17
15
7

CLEANING AND DOPING OF TUBULARS

The present invention relates to a method and apparatus for cleaning and doping tubulars and in particular, though not necessarily, to a method and apparatus for cleaning and doping tubulars used in the oil industry.

The construction, operation, and maintenance of oil wells and other boreholes requires the use of long strings of tubulars which are joined end to end using threaded joints. Such a string may for example form a shaft for a drill bit or a casing for conducting fluid (e.g. oil) from the bottom of a well to the surface. The integrity of the joints between adjoining tubulars is often critical, particularly where the tubing string is being used to carry fluid under high pressure. The contamination of tubular ends with dirt and the like, and the corrosion of these ends, can seriously compromise joint integrity. It will be appreciated that both contamination and corrosion are serious problems especially in off-shore drilling environments where salt water, oil, and mud abound.

It is common practice when running a tubing string into or out of a wellbore to clean the threaded joints prior to making or breaking a joint. Either the female part of a joint (the "box") or the male part (the "pin") or both may be cleaned. Joints may also be lubricated, a process known in the industry as "doping". EP338222 describes a substantially manually operated system for doping the box of a tubular. The apparatus used comprises a rotating head for dispensing lubricant and is manually placed inside the box to be doped whereupon the rotating lubricating head is activated. The apparatus is then withdrawn from the box. Alternative doping (and cleaning) systems are described in WO95/25215, DE3537633, U.S. Pat. No. 5,518,076, and CH571,365. However, these system either require significant manual involvement or are unsuitable for use in a rig floor environment. Despite the proposals put forward in the patent literature, in practice, threaded joints are cleaned and doped using cloths, brushes and the like.

It is an object of the present invention to overcome or at least mitigate the disadvantages of the prior art discussed above. In particular, it is an object of the present invention to provide a remote control system for cleaning and doping tubular joints.

According to a first aspect of the present invention there is provided apparatus for cleaning and doping a joint member-of a tubular, the apparatus comprising:

- a nozzle unit for rotation about a longitudinal axis and coupled to a source of lubricant; and
- a cleaning unit coupled to a source of cleaning fluid.

According to a second aspect of the present invention there is provided apparatus for cleaning and doping a joint member of a tubular during the making or breaking of a string on a well platform, the apparatus comprising:

- a housing having first and second opposed ends and arranged in used to be secured at its first end to said well platform or to a moveable arm, said second end having an opening therein for receiving the joint member to be cleaned and doped;
- a nozzle unit mounted in or to the housing for rotation about a longitudinal axis of the housing and coupled to a source of lubricant; and
- a cleaning unit mounted in or to the housing.

Certain embodiments of the present invention provide an apparatus which enables remote placement of the apparatus over a joint member, or remote placement of a joint member into the apparatus. The need for personnel to enter a potentially dangerous zone during a cleaning and doping operation is substantially eliminated.

Preferably, said cleaning unit is axially displaced from said nozzle unit and is coupled to a source of cleaning fluid.

Preferably, the housing is arranged such that the leakage of fluid and lubricant from the opening in the second end of the housing during a cleaning and doping operation is substantially prevented. This may be achieved, for example, by appropriately sizing the opening and/or by providing a sealing member around the periphery of the opening.

Preferably, the inner space of the housing is connected to a suction unit, so that in use excess lubricant can be removed from the housing.

The nozzle unit may be located below the cleaning unit, or vice versa.

In certain embodiments of the present invention, said cleaning fluid is a liquid, and the apparatus comprises a drying unit mounted in or to the housing.

The cleaning and drying units may comprise respective axially spaced rings, each of which comprises a multiplicity of radially spaced nozzles or openings. A first of these rings may be coupled to said source of cleaning liquid whilst the second is coupled to a source of drying gas. More preferably, said cleaning liquid is fresh water, whilst said drying gas is air. Alternatively however, said liquid may be some other solvent and said gas may be some other suitable gas such as nitrogen.

In other embodiments of the invention, the cleaning fluid is a gas, for example air. In a preferred embodiment, said cleaning unit comprises one or more linear arrays of gas jets, the or each array being aligned with said longitudinal axis. More preferably, the cleaning unit comprises two linear arrays of gas jet nozzles oriented to direct gas onto the surface at an angle substantially tangential to the surface of a tubular. The respective sets of gas jets produced by the two arrays impact on the surface of a tubular in proximity to one another, arriving from substantially opposite directions. The arrays of gas jet nozzles may be arranged in use to be rotated about a tubular. The nozzles may be mounted for rotations with the lubricant spraying nozzle unit.

In certain embodiments of the invention, the apparatus is arranged to clean the pin member of a tubular. The doping unit is arranged to rotate around the outside of the pin when it is inserted into the housing, the cleaning and doping actions being directed radially inward. In other embodiments of the invention, the apparatus is arranged to clean the box member of a tubular. The doping unit is arranged to rotate around the inside of the box when it is inserted into the housing, the cleaning and doping actions being directed radially outward.

Preferably, the nozzle unit comprises an array of interspersed gas and lubricant nozzles coupled respectively to a source of pressurised gas and said source of lubricant. In use, lubricant ejected from the lubricant nozzles is sprayed onto the joint member to be doped by the force applied by gas ejected from the gas nozzles. In one embodiment the gas and lubricant nozzles are arranged in substantially the same plane. In another embodiment, the gas nozzles are located in a common plane, behind a line of lubricant nozzles. More preferably, the number of gas nozzles is significantly greater than the number of gas nozzles.

Preferably, the array of interspersed gas and lubricant nozzles is an elongate array having its axis substantially aligned with the axis of the housing. More preferably, the length of the nozzle array is substantially the same as, or exceeds that of, the joint member to be doped.

Preferably, the apparatus comprises guide means for guiding the joint member of the tubular into the opening in the housing. This guide means may comprise, for example, one or more guide members located around the periphery of the opening.

According to a third aspect of the present invention there is provided a method of cleaning and doping a joint member of a tubular during the making or breaking of a string on a well platform, the method comprising:

inserting the joint member into an opening in an end of a housing containing or mounting cleaning and nozzle units, the housing being fixed to the well platform or to a moveable arm;

activating the cleaning unit to clean the joint member using cleaning fluid;

activating the nozzle unit to spray lubricant onto a surface of the joint member; and withdrawing the joint member from the housing.

The housing may additionally contain a drying unit, in which case the cleaning unit may clean the joint member using cleaning fluid, the method further comprising activating the drying unit to dry the joint member.

In certain embodiments of the present invention, said housing is fixed to the well platform at an end opposed to said end having the opening therein. Said step of inserting the joint member into said opening comprises remotely positioning said tubular above the opening in the housing, and lowering the tubular so that the joint member of the tubing enters the housing through the opening. Said step of withdrawing the joint member from the housing comprises remotely raising the tubular to withdraw the joint member from the housing.

In other embodiments of the invention, said housing is fixed to a robotic arm at an end opposed to said end having the opening therein. Said step of inserting the joint member into said opening comprises remotely positioning the housing above joint member to be cleaned and doped, lowering the housing so that the joint member of the tubing enters the housing through the opening. Said step of withdrawing the joint member from the housing comprises remotely raising the housing to withdraw the joint member from the housing.

According to a fourth aspect of the present invention there is provided a method of cleaning and doping a joint member of a tubular during the making or breaking of a string on a well platform, the method comprising:

inserting the joint member into an opening in an end of a housing containing or mounting cleaning and nozzle units, the housing being fixed to the well platform or to a moveable arm;

activating the cleaning unit to cause two sets of gas jets to be directed onto a surface region of the joint member from substantially opposite directions so as to clean the surface of the joint member;

activating the nozzle unit to spray lubricant onto a surface of the joint member; and withdrawing the joint member from the housing.

According to a fourth aspect of the present invention there is provided apparatus for doping a joint member of a tubular, the apparatus comprising a nozzle unit arranged for rotation about a longitudinal axis, the nozzle unit comprising an array of interspersed gas and lubricant nozzles coupled respectively to a source of pressurised gas and a source of lubricant.

Preferably, the apparatus is for use during the making or breaking of a string on a well platform and comprises a housing having first and second opposed ends arranged in use to be secured at its first end to said well platform or to a moveable arm, said second end having an opening therein for receiving the joint member to be cleaned and doped.

In one embodiment the gas and lubricant nozzles are arranged in substantially the same plane. In another embodiment, the gas nozzles are located in a common plane, behind a line of lubricant nozzles. More preferably, the number of gas nozzles is significantly greater than the number of lubricant nozzles.

Preferably, the array of interspersed gas and lubricant nozzles is an elongate array having its axis substantially aligned with the axis of the housing. More preferably, the length of the nozzle array is substantially the same as, or exceeds that of, the joint member to be doped.

For a better understanding of the present invention and in order to show how the same may be carried into effect reference will now be made by way of example to the accompanying drawings in which.

Figure 1:
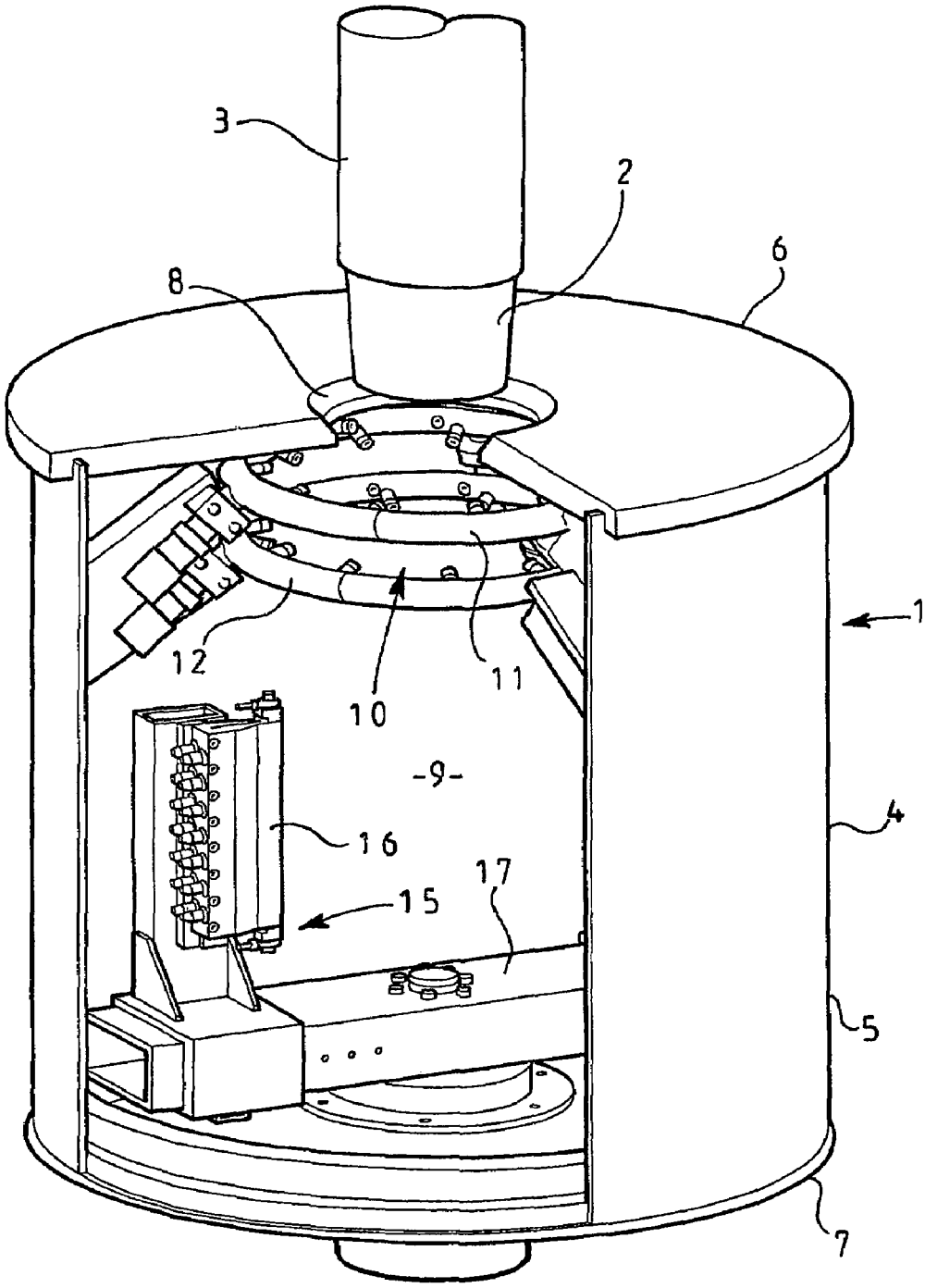
FIG. 1 illustrates in partial section a cleaning and doping unit located beneath a tubular.

There is illustrated in FIG. 1 a cleaning and doping unit 1 for use in the contactless cleaning and doping of pins 2 of tubulars 3 during the making or breaking of a string of tubulars on an oil platform. The string may for example be a drill string or a well casing. The unit 1 is shown in partial cut-away and has an outer housing 4 comprising a cylindrical body 5 and top and bottom ends 6,7. The top end 6 has an opening 8 therein, sized to allow the end of a tubular 3 to be inserted into the inner space 9 of the unit 1.

Figure 2:
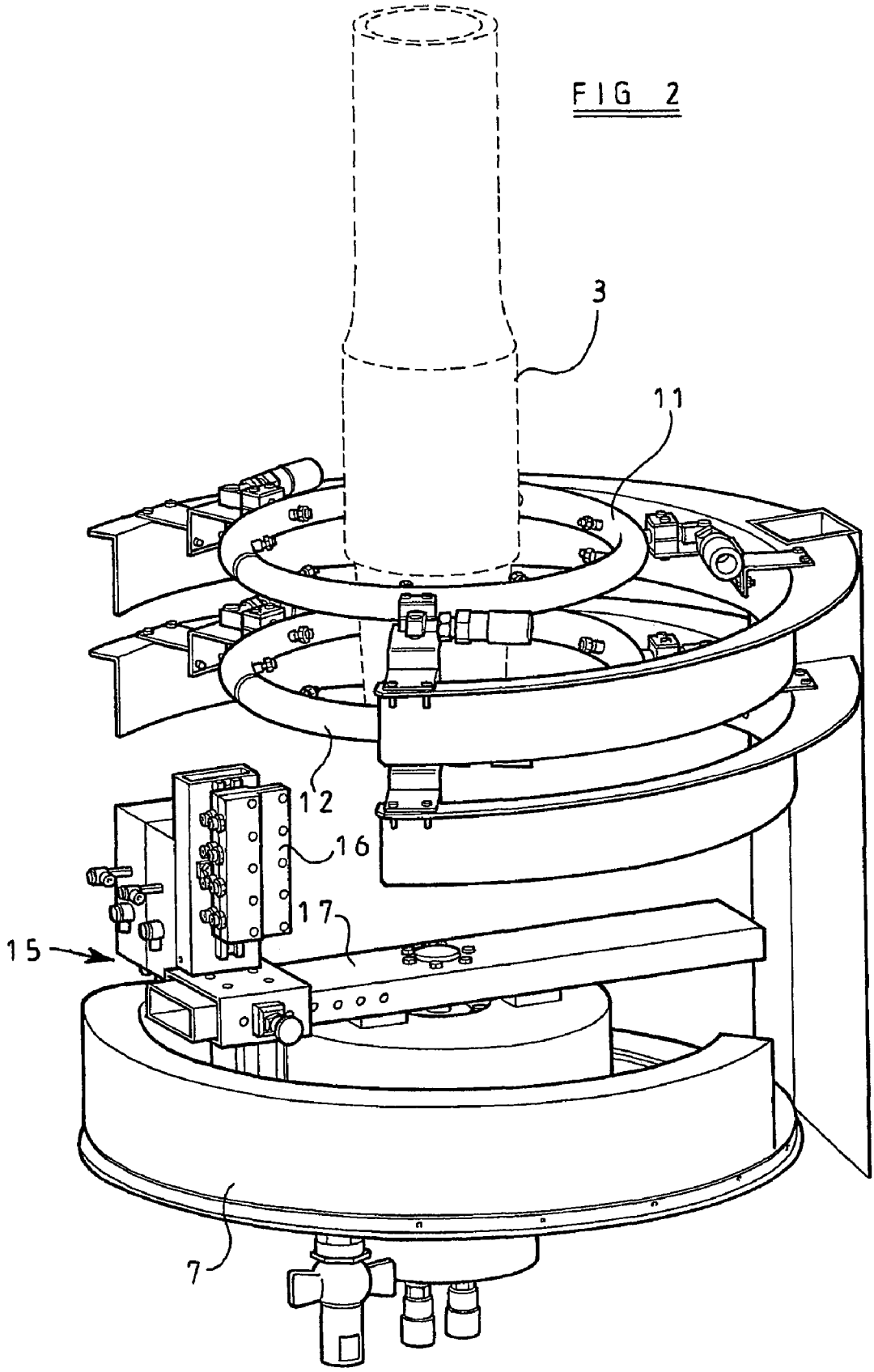
FIG. 2 illustrates in detail the internal structure of the unit of FIG. 1.
Figure 3:
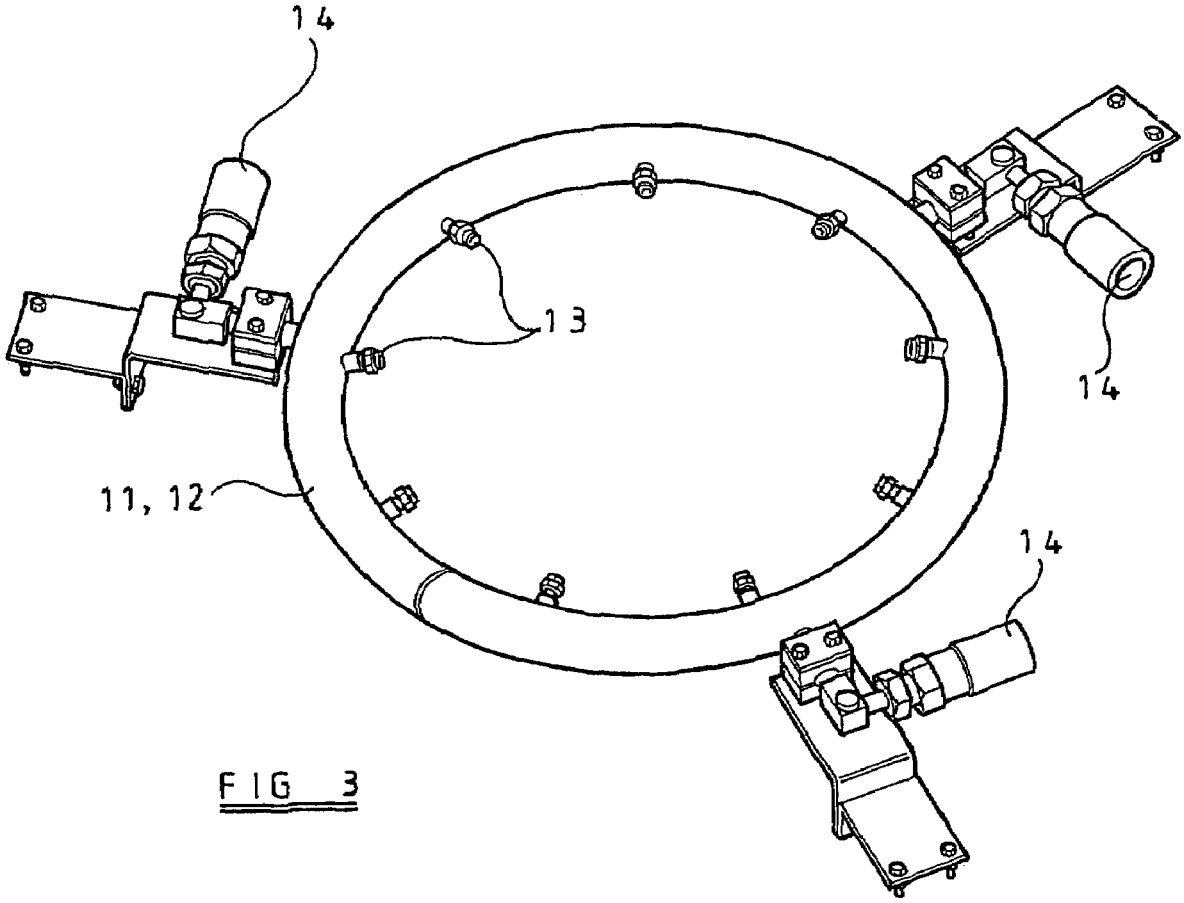
FIG. 3 illustrates a cleaning ring of the unit of FIG. 1.

As is illustrated in more detail in FIG. 2 (which shows the internal structure of the cleaning and doping unit 1), inside the inner space 9 of the unit 1 and beneath the opening 8 in the housing 4 there is provided a washing and drying unit 10. This unit 10 comprises an upper washing ring 11 coupled to an external source of fresh water (under pressure) and a lower drying ring 12 coupled to an external source of pressurised air. One such ring is illustrated in more detail in FIG. 3 (the washing and drying rings 11,12 have substantially the same construction) and comprises multiple inwardly directed nozzles 13 and three water/air supply couplings 14 to which the external water/gas source is connected. The rings 11,12 are arranged concentrically about the longitudinal axis of the housing 4 so that a tubular 3 may be lowered through the rings.

Located beneath the washing and drying rings 11,12 is a doping unit 15 comprising a nozzle array 16 mounted on an arm assembly 17. The doping unit 15 is slidably mounted on the arm assembly 17 such that the radial position of the doping unit 15 can be varied to accommodate different sizes of tubulars (and pins). The arm assembly 17 is rotatably fixed to the centre of the bottom end 7 of the housing 4, so that the doping unit 15 can be rotated about the longitudinal axis of the housing 4. The nozzle array 16, which is mounted to the arm assembly 17 in a vertical plane, is shown in more detail in FIG. 4. The array 16 comprises two lines of air supply nozzles 18 formed in a block 19. The nozzles 18 are coupled to an external pressurised air supply via couplings 20 and a rotatable coupling (not shown). Interspersed between the air supply nozzles 18 are a series of four lubricant supply nozzles 21, the lubricant supply nozzles 21 being coupled to an external supply of pressurised lubricant via four couplings 22 and a rotatable coupling (not shown). In use, lubricant is forced through the lubricant supply nozzles 21 and is atomised and accelerated inwardly by the air exiting from the air supply nozzles 18. Typically, a metering unit may be incorporated into the lubricant couplings, or into the doping unit 15, to accurately control the volume and rate of lubricant delivered to the nozzles 21.

Not shown in the Figures is a suction unit which is connected via an appropriate coupling in the base of the housing 4 to the inner space 9. This unit is arranged in use to suck used water and excess lubricant from the space 9. This avoids a build up of these materials inside the housing 4. In some circumstances, water and/or lubricant may be recycled for repeated use.

Figure 4:
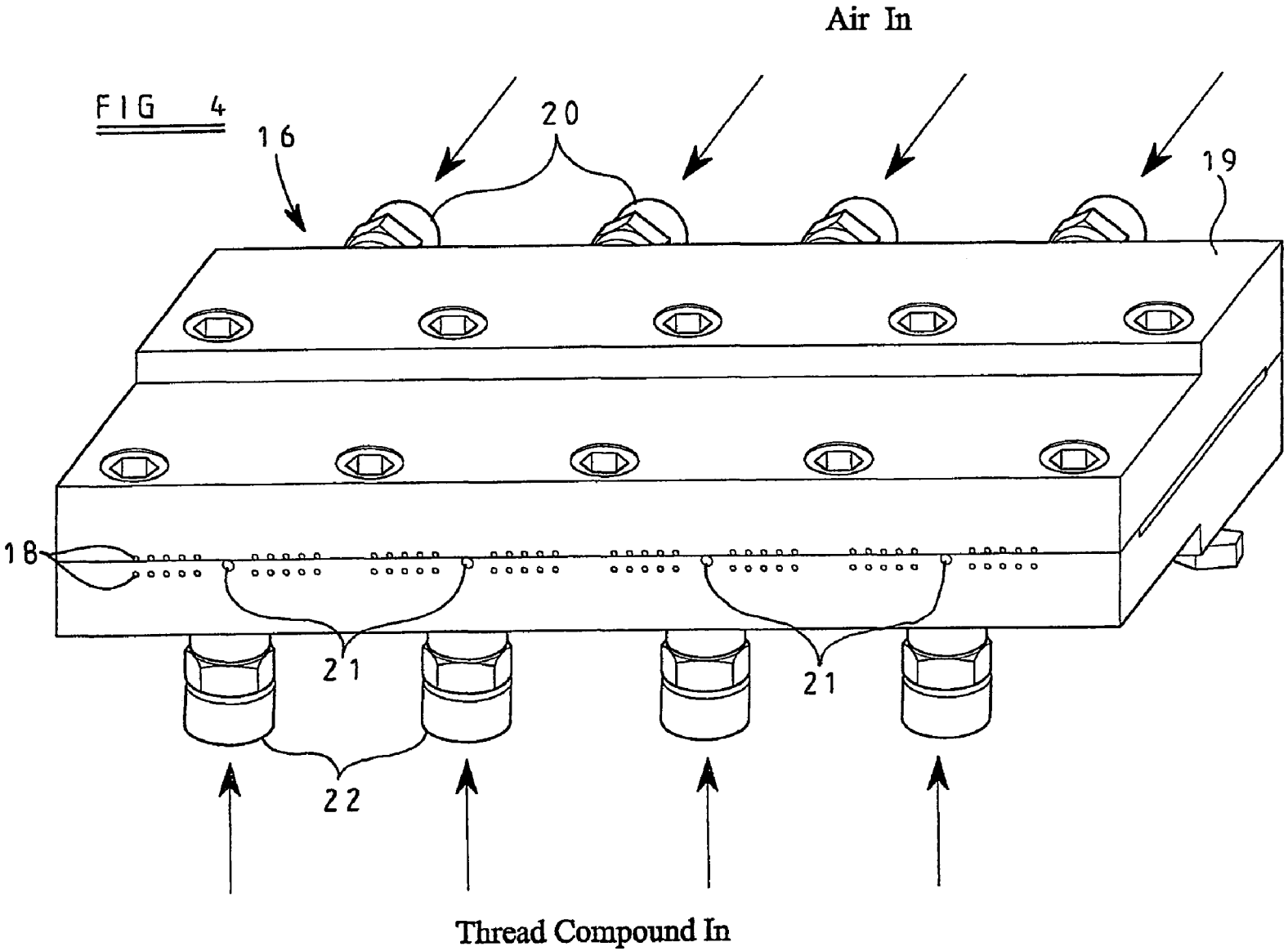
FIG. 4 illustrates a nozzle array for use in the unit of FIG. 1.
Figure 5:
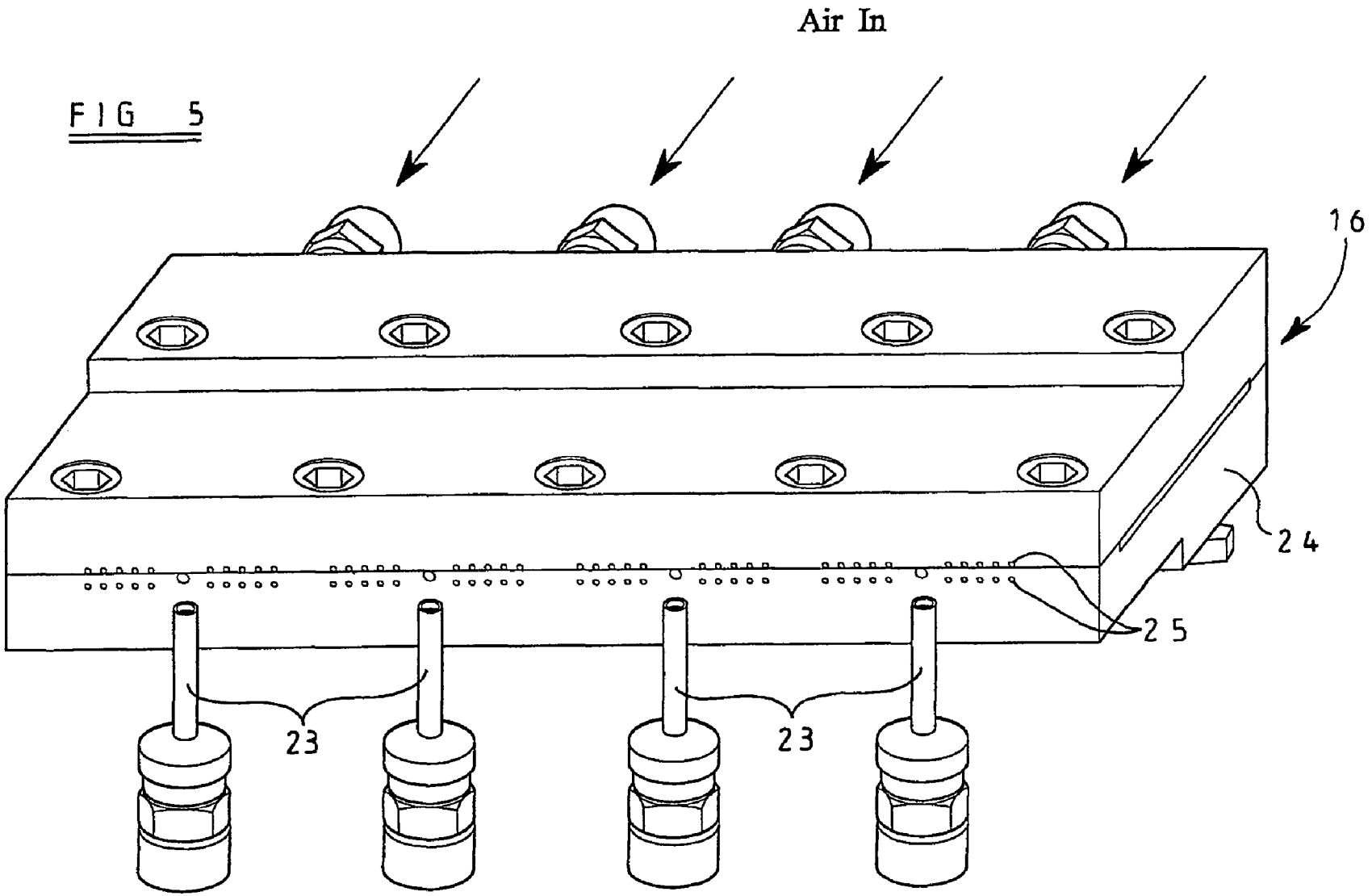
FIG. 5 illustrates an alternative nozzle array for use in the unit of FIG. 1.

FIG. 5 illustrates an alternative nozzle array 16 which differs from that shown in FIG. 4 in so far as the lubricant supply nozzles 23 are not integrated into a block 24, but are located outside of the block 24 in front of the air supply nozzles 25.

Figure 6:
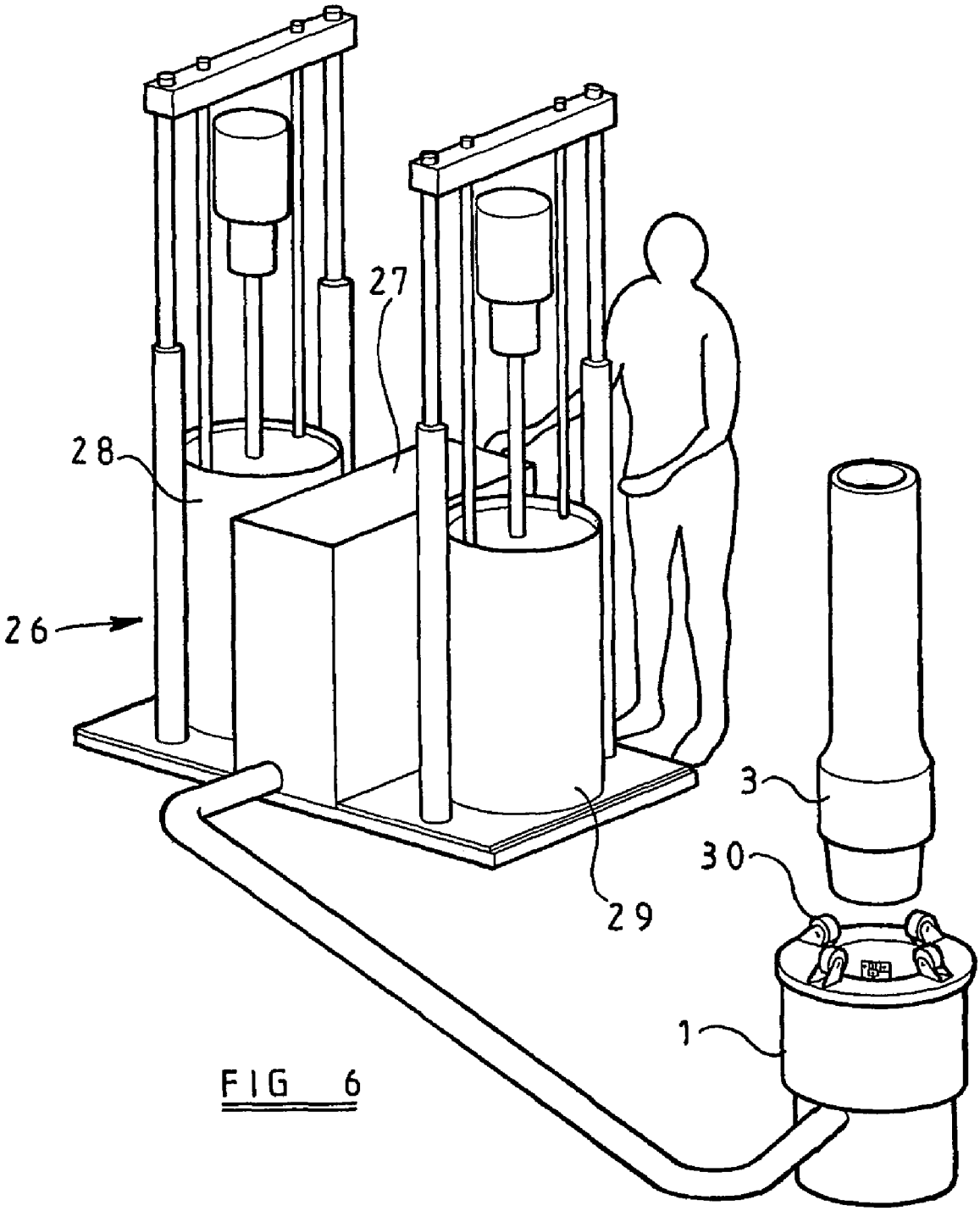
FIG. 6 illustrates the unit of FIG. 1 located on the floor of a well platform.
Figure 7:
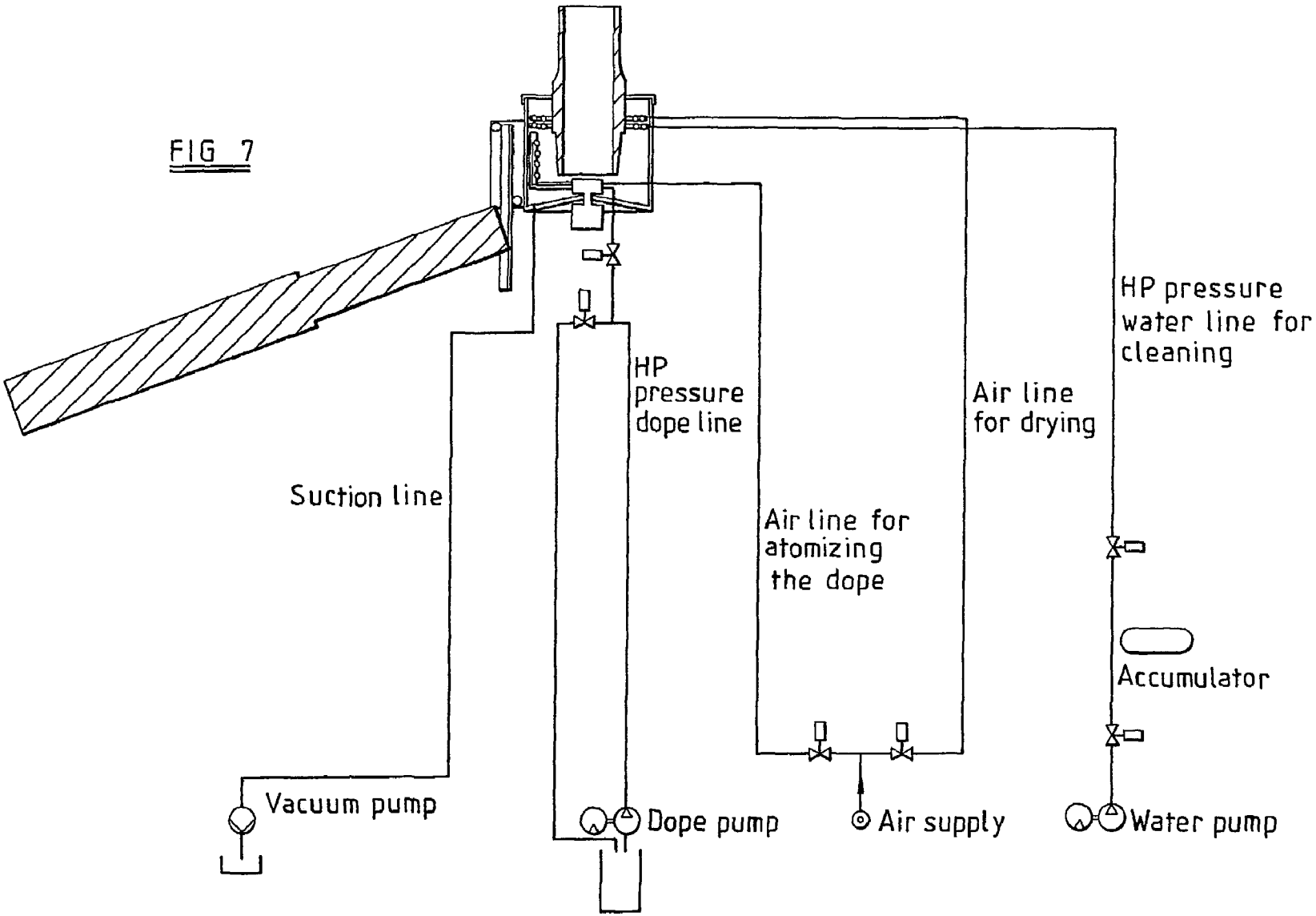
FIG. 7 illustrates schematically a water, air, and lubricant supply system for the unit of FIG. 1.

FIG. 6 illustrates the unit 1 of FIG. 1 mounted on a well platform and coupled to a remote control unit 26 on which are mounted lubricant, water, and air supply tanks 27,28,29. FIG. 7 illustrates schematically the arrangement of the lubricant, water, and air supply lines (together with a suction line) and respective control valves. It will be understood that the remote control unit 26 is located away from the well head, in a safe area. In use, a threaded pin 2 of a tubular 3 to be cleaned is suspended from an elevator (not shown) and is brought to a position above the opening 8 in the cleaning and doping unit 1. In order to assist the insertion of the pin 2 into the unit 1, a set of guides 30 may be provided around the periphery of the opening 8. As shown in FIG. 6, these guides 30 may comprise rollers.

Figure 8:
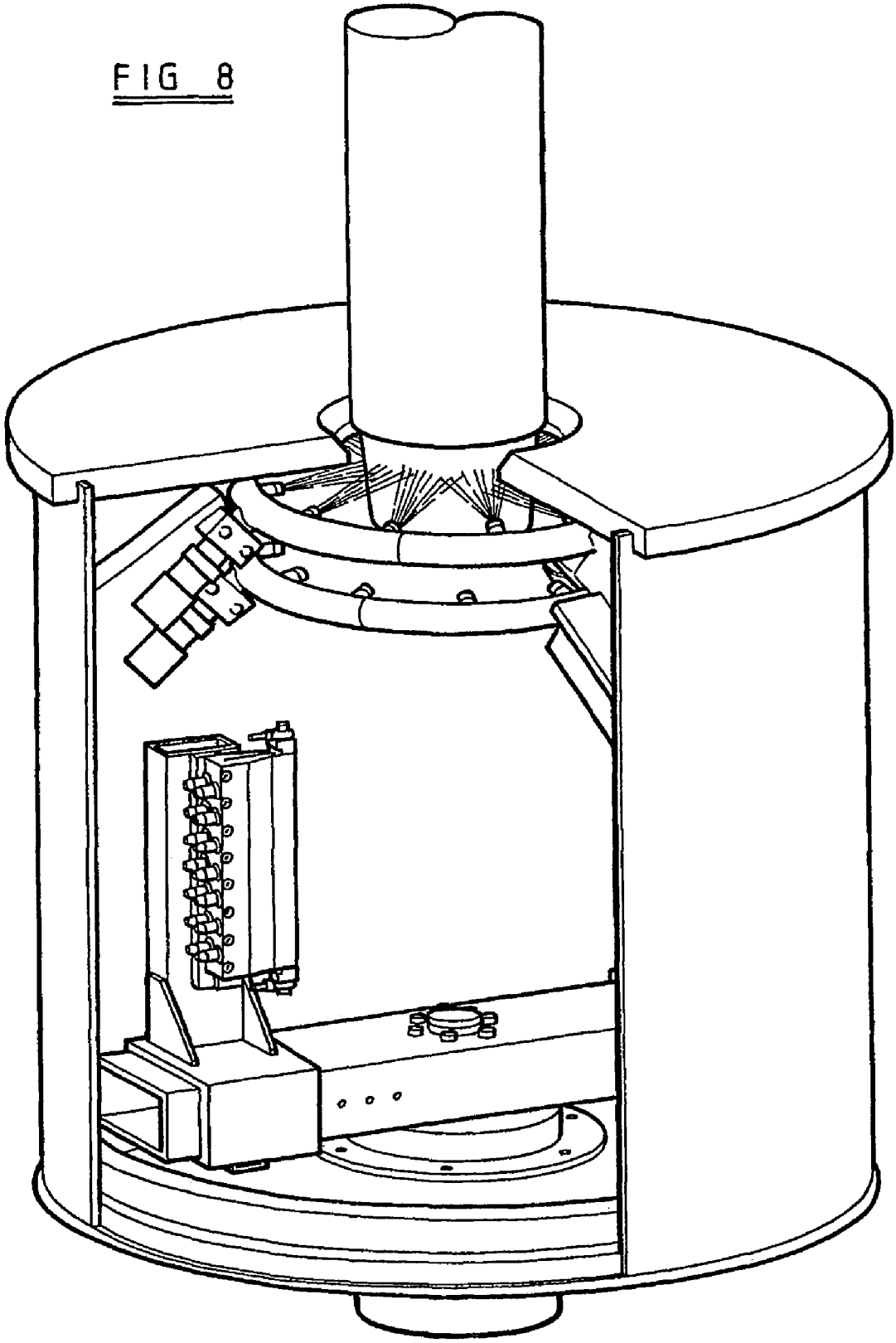
FIG. 8 illustrates a first operational position of a tubular in the unit of FIG. 1.

The pin 2 of the tubular 3 is then lowered into the opening 8. A first sensor unit (not shown) mounted within the housing 4 detects the entry of the tubular 3 and activates the washing ring 11 to spray water under high pressure onto the surface of the pin. This stage of the operation is illustrated in FIG. 8. As the tubular 3 continues to be lowered, the passage of the pin 2 through the washing ring 11 is detected by a second sensor unit (not shown). This causes the washing ring 11 to be turned off, and the drying ring 12 activated to blow air onto the surface of the pin 2 to dry the pin. A third sensor unit (not shown) detects the exit of the pin from the drying ring 12 and causes the drying ring to be turned off and the doping unit 15 to be activated.

Figure 9:
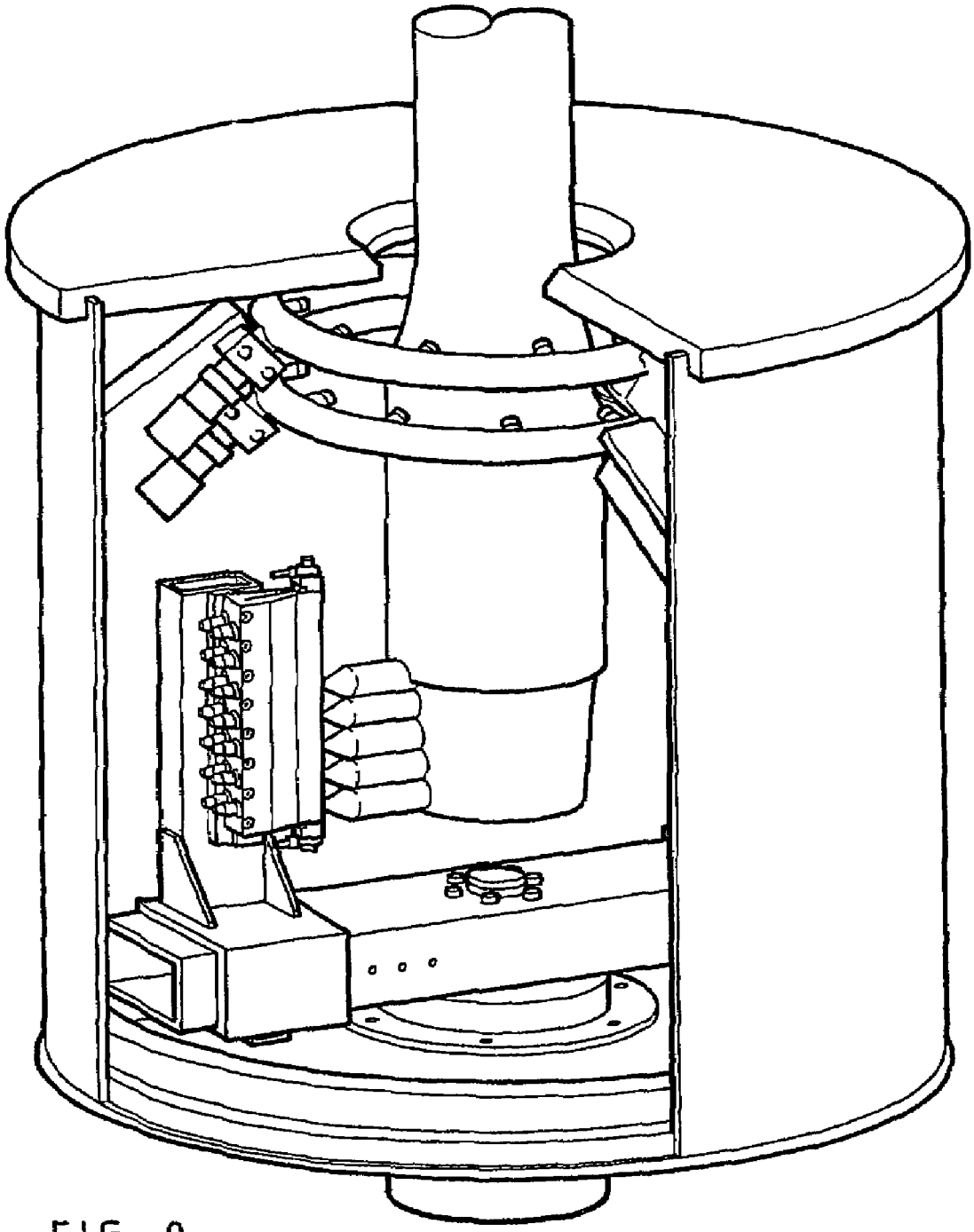
FIG. 9 illustrates a second operational position of a tubular in the unit of FIG. 1.

Once activated, the arm assembly 17 of the doping unit 15 begins to rotate, rotating the nozzle array around the pin 2. Lubricant is supplied to the lubricant supply nozzles 20, and air to the air supply nozzles 18 as illustrated in FIG. 9. The arrangement of the nozzles 18,20 results in a finely directed spray of lubricant onto the pin 2, which in turn results in a controllable and uniform film of lubricant on the pin 2. This arrangement also reduce overspill and waste of lubricant. The doping unit 15 remains active for a predefined time period, sufficient to rotate around the pin 2 one or more times. Once deactivated, a notification may be give to the operator (e.g. by an indicator light on the control panel) that the cleaning and doping operation has been completed and the tubular 3 can be removed from the unit 1. The tubular is then raised on the elevator to remove the pin 2 from the unit 1. The tubular 3 can then either be placed on a storage rack (in the case of the breaking of a string) or moved into a position for connection to the box of a tubular at the top of the well head.

It will be appreciated that the operation of the cleaning and doping unit may be further automated such that the operation of the elevator is controlled to some extent by the position of a tubular relative to and within the unit 1. For example, the lowering of the tubular may be halted for a short time at each of the washing and drying stages. Also, the tubular may be automatically raised when the end of the lubricating stage is reached.

Figure 10:
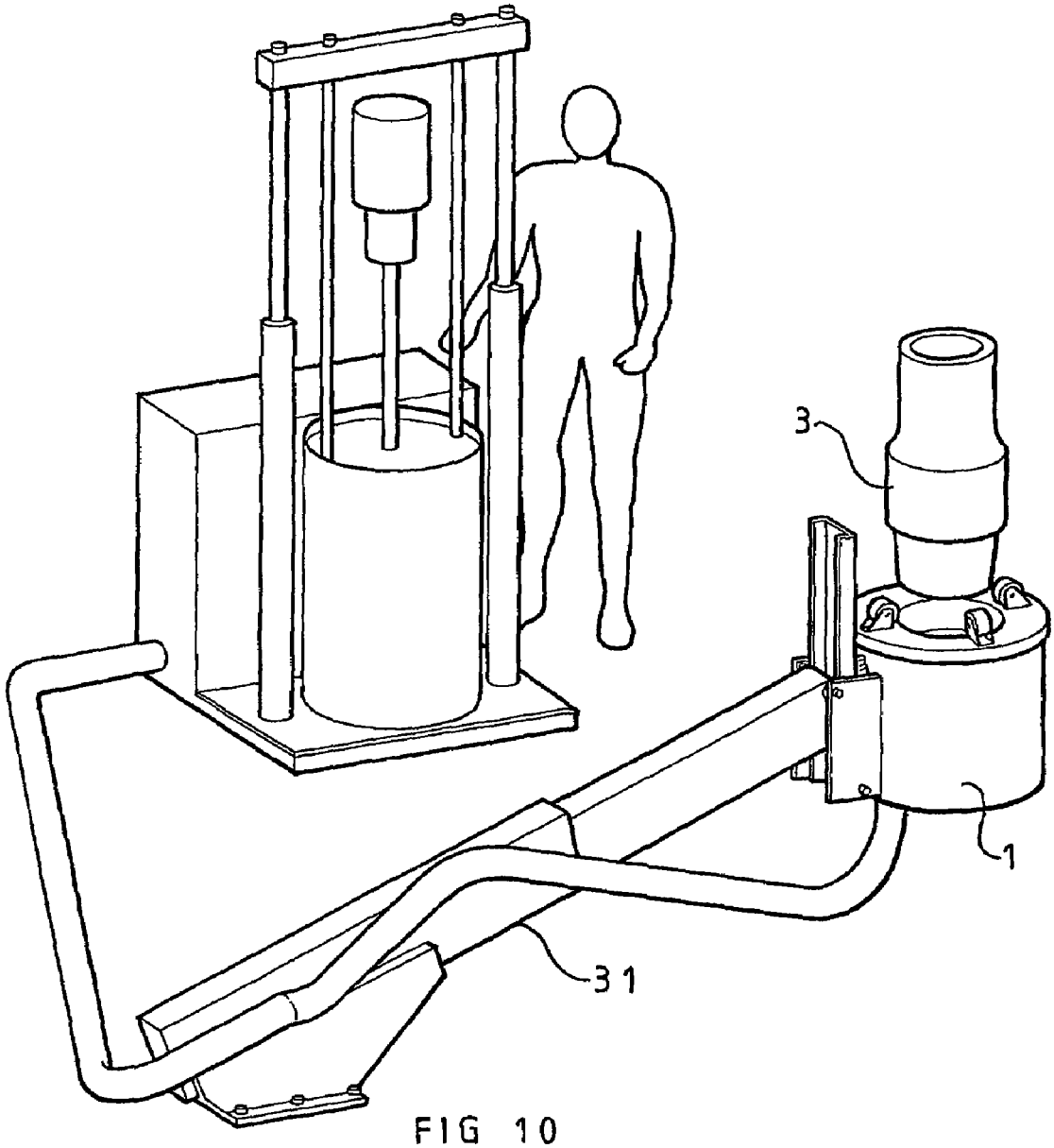
FIG. 10 illustrates the unit of FIG. 1 mounted on a robotic arm for cleaning pins.

FIG. 10 illustrates an arrangement where the cleaning and doping unit 1 is mounted on the end of a robotic arm 31, rather than being fixed to the platform floor. This arrangement allows for greater flexibility and more particularly allows the unit 1 to be removed from the area of the well head when it is not in use.

Figure 11:
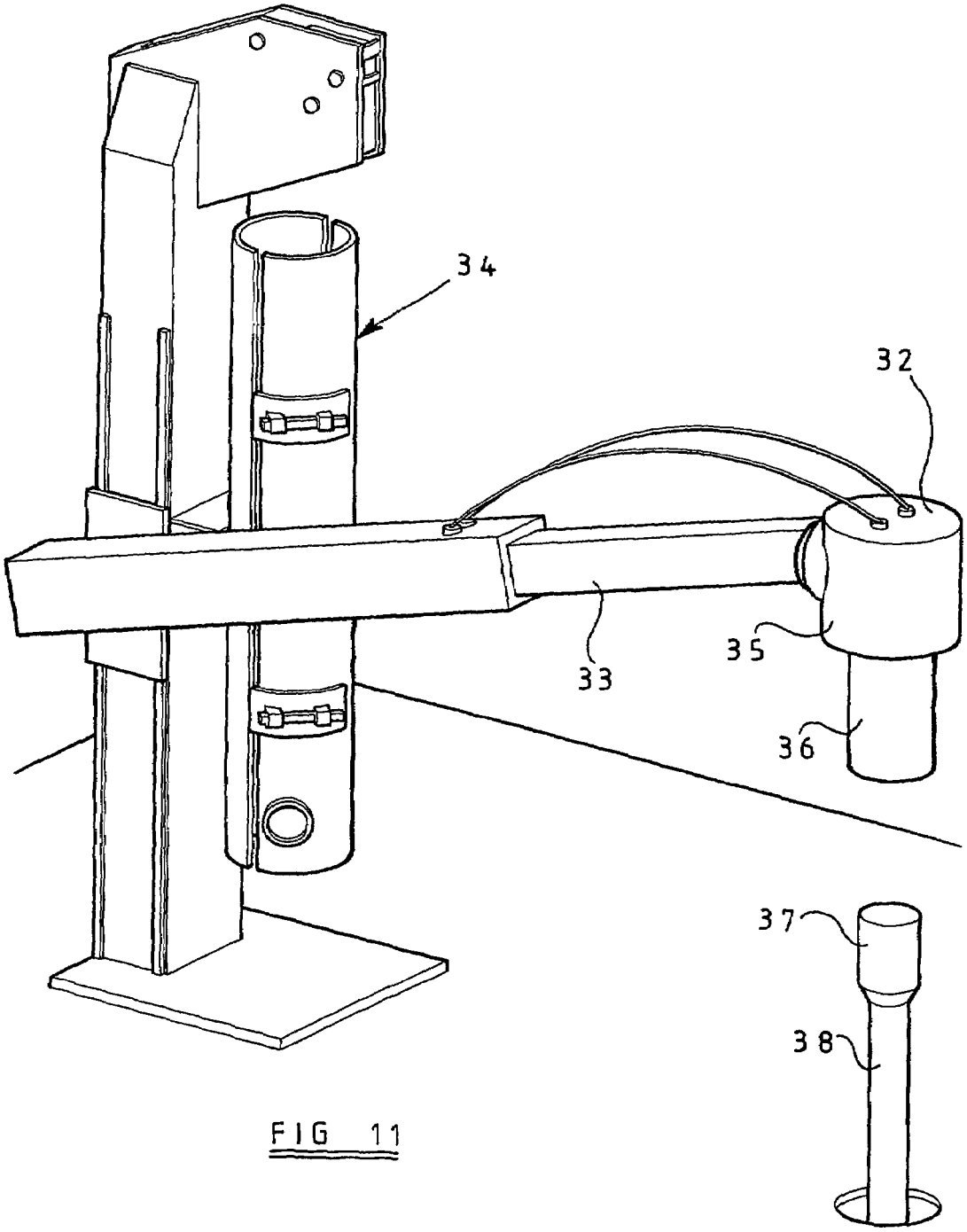
FIG. 11 illustrates a cleaning and doping unit mounted on a robotic arm for cleaning boxes.

The above description has concerned apparatus for cleaning and doping the pin of a tubular. The present invention may also be employed in the cleaning and doping of threaded boxes. An apparatus suitable for this operation is shown in FIG. 11 and comprises a cleaning and doping unit 32 mounted on the end of a robotic arm 33 which is in turn mounted on a stand and actuating unit 34. The housing 35 of the unit 32 is inverted with respect to the rig floor, when compared to the housing 4 described above. The washing, drying, and doping units (not shown) are mounted on a central member 36 which projects from the housing 35, such that their action is directed radially outwards. The housing acts as a cap for the end of the box 37 of a tubular 38 (projecting from the well head), sealing the end of the box 37 when the washing, drying, and doping units are fully inserted into the box 37. This substantially prevents leakage of fluids and gas onto the platform.

Figure 12:
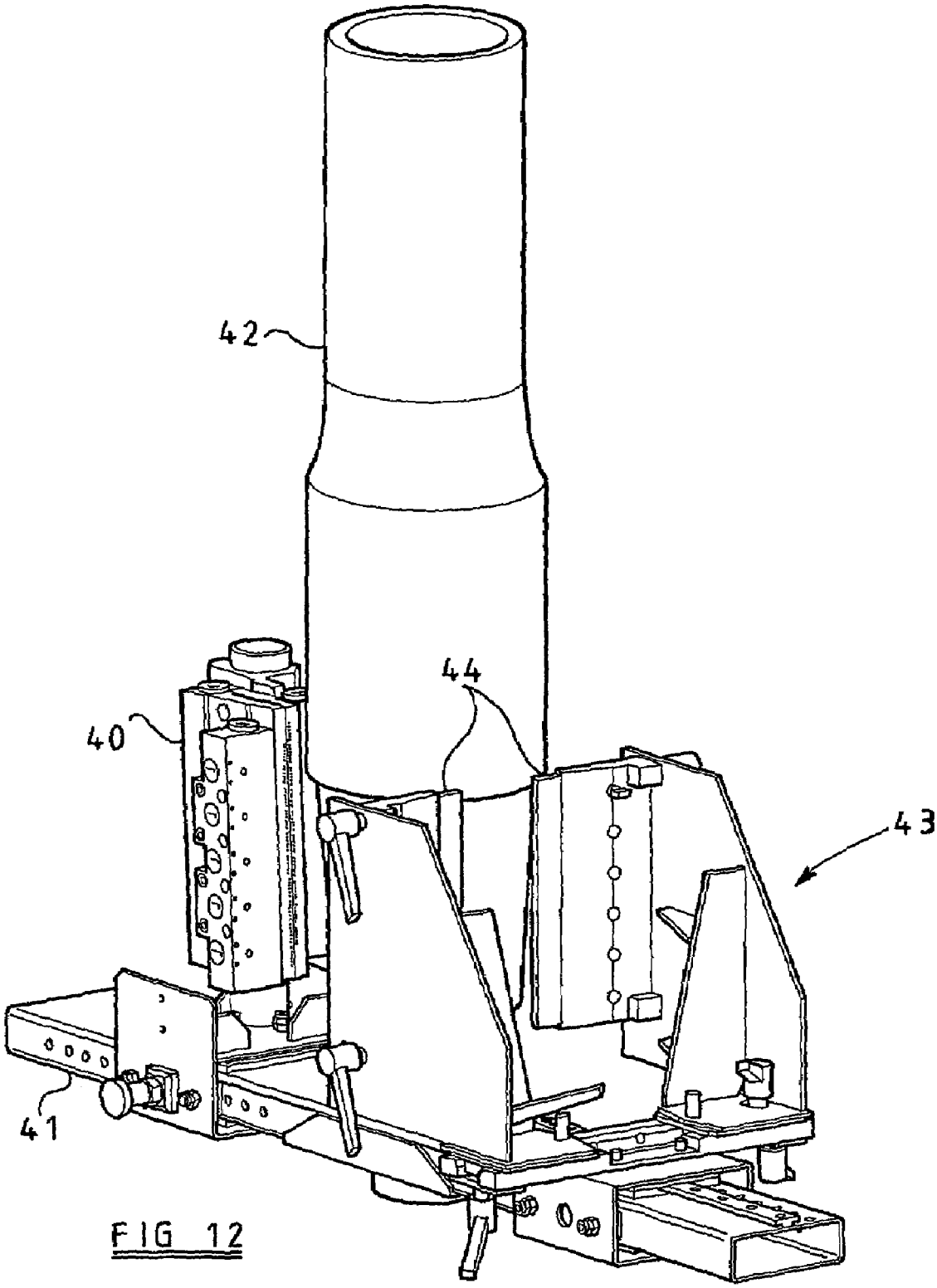
FIG. 12 is a perspective view of a cleaning and doping system comprising an air cleaning mechanism.
Figure 13:
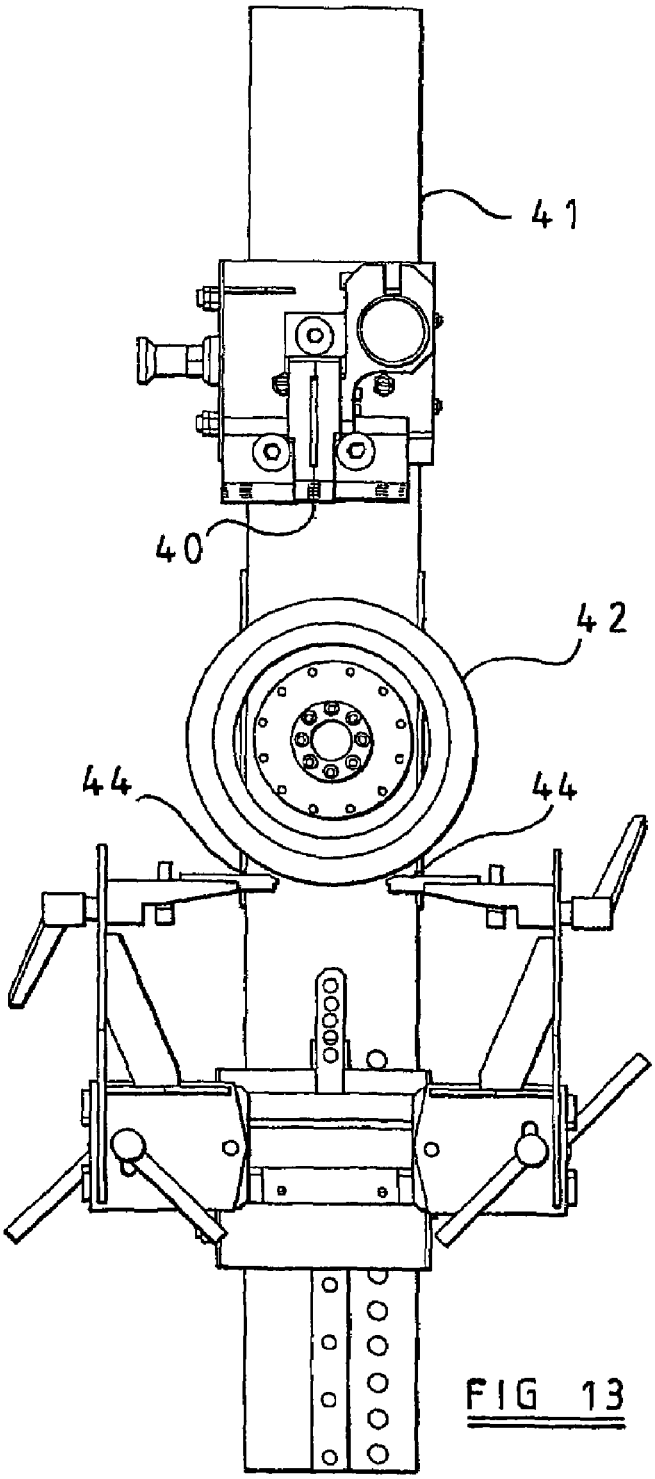
FIG. 13 is a plan view of the system of FIG. 12.

There is illustrated in FIGS. 12 and 13 an alternative cleaning and doping system which relies on a multiplicity of air jets to remove dirt from the surface of a tubular. Thus, the system does not require a separate drying unit. In the interests of clarity, the housing surrounding the cleaning and doping units are omitted in FIGS. 12 and 13. However, it will be apparent that the housing will be similar to that illustrated in FIG. 1.

Figure 14:
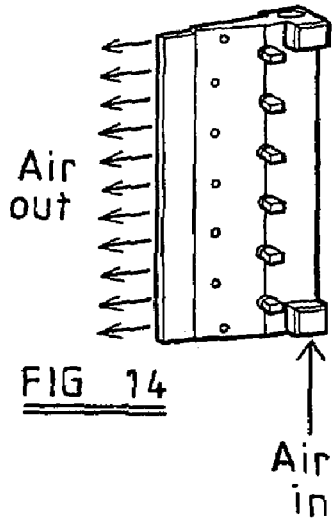
FIG. 14 illustrates an air nozzle array of the system of FIG. 12.

The system comprises a nozzle array 40 which corresponds to one of the arrays in FIG. 4 or 5. The array 40 is mounted on a rotatable arm 41 for rotation about the central axis of the system (and a round a tubular 42 inserted into that housing). Mounted on the opposed end of the arm 41 is a cleaning unit 43. The cleaning unit 43 comprises a pair of air nozzle arrays 44, each of which has the structure illustrated in FIG. 14. A linear array of air nozzles are coupled to a single source of pressurised air (not shown) such that in use they generate a linear array of air jets. The two air nozzle arrays 44 are oriented such that in use they generate air jet arrays which are directed onto closely spaced areas of the tubular 42. The air jet arrays arrive at the surface of the tubular from substantially opposite directs and impact tangentially on the surface. This has the effect of "squeezing"

dirt between the jet arrays, and then throwing that dirt of the surface (the use of a single set of air jets might merely result in dirt being swept around the surface of the tubular ahead of the jets). Typically, once the tubular 42 has been cleaned with the air jets (which may require several rotations of the cleaning unit around the tubular 42), the nozzle array 40 is operated and rotated about the tubular 42 to dope the surface.

It will be appreciated by the person of skill in the art that modifications may be made to the above described embodiments without departing from the scope of the present invention. For example, while the above embodiment has been described for use on an oil platform, the invention may be employed in a pipe yard where tubulars are stored (outside) for extended periods of time. In a modification to the embodiments described above with reference to FIGS. 1 to 11, a joint may be dried using a heating coil rather than using a drying gas.

The invention claimed is:

1. Apparatus for cleaning and doping a joint member of a tubular during making or breaking of a string on a well platform, the apparatus comprising:

a housing having first and second opposed ends, said second end having an opening therein for receiving the joint member to be cleaned and doped;

a nozzle unit mounted in or to the housing at a first axial location for rotation about a longitudinal axis of the housing and coupled to a source of lubricant; and a cleaning unit mounted in or to the housing at a second axial location and coupled to a source of cleaning fluid, wherein the nozzle unit is directed at a surface cleaned by the cleaning unit, wherein the first axial location is separate from the second axial location.

2. Apparatus according to claim 1, wherein the housing is arranged in use to be secured at its first end to said well platform or to a movable arm.

3. Apparatus according to claim 1, wherein the housing is arranged such that a leakage of fluid and lubricant from the opening in the second end of the housing during a cleaning and doping operation is substantially prevented.

4. Apparatus according to claim 1, wherein said cleaning fluid is a liquid, and the apparatus comprises a drying unit mounted in or to the housing.

5. Apparatus according to claim 1, wherein an inner space of the housing is connected to a suction unit, so that in use excess cleaning fluid and lubricant is removed from the housing using the suction unit.

6. Apparatus according to claim 1, wherein the cleaning fluid is a gas and said cleaning unit comprises one or more linear arrays of gas jets, wherein the one or more linear arrays is aligned with said longitudinal axis.

7. Apparatus according to claim 6, wherein the cleaning unit comprises two linear arrays of gas jet nozzles oriented to direct gas onto a surface of the tubular at an angle substantially tangential to said surface such that the respective sets of gas jets produced by the two arrays impact on said surface in proximity to one another, arriving from substantially opposite directions.

8. Apparatus according to claim 1, wherein the nozzle unit is located below the cleaning unit.

9. Apparatus according to claim 1, wherein the cleaning unit comprises two respective axially spaced rings, each of which comprises a multiplicity of radially spaced nozzles or openings, a first of these rings being coupled to a source of cleaning liquid whilst a second is coupled to a source of drying gas.

10. Apparatus according to claim 1, wherein the apparatus is arranged to clean a pin member of the tubular.

11. Apparatus according to claim 10, wherein the nozzle unit is arranged to rotate around an outside of the pin member when the pin member is inserted into the housing, and the nozzle unit is arranged to act radially inward.

12. Apparatus according to claim 1, wherein the apparatus is arranged to clean a box member of the tubular.

13. Apparatus according to claim 12, wherein the nozzle unit is arranged to rotate around an inside of the box member when the pin member is inserted into the housing, and the nozzle unit is arranged to act radially outward.

14. Apparatus according to claim 1, wherein the nozzle unit comprises an array of interspersed gas and lubricant nozzles coupled respectively to a source of pressurised gas and said source of lubricant such that in use lubricant ejected from the lubricant nozzles is sprayed onto the joint member to be doped by a force applied by a gas ejected from the gas nozzles.

15. Apparatus according to claim 14, wherein the gas and lubricant nozzles are arranged substantially on a common plane.

16. Apparatus according to claim 14, wherein the gas nozzles are located in a common plane, behind a line of lubricant nozzles.

17. Apparatus according to claim 14, wherein the array of interspersed gas and lubricant nozzles is an elongate array having an axis substantially aligned with the axis of the housing.

18. Apparatus according to claim 17, wherein a length of the nozzle array is substantially the same as, or exceeds, a length of the joint member to be doped.

19. Apparatus according to claim 1 further comprising guide means for guiding the joint member of the tubular into the opening in the housing.

20. The apparatus of claim 1, wherein the nozzle unit and the cleaning unit as sequentially activated as the joint member is inserted into the housing.

21. A method for cleaning and doping a joint member of a tubular, the method comprising:

inserting the joint member into an opening in an end of a housing which contains, or to which are mounted, a cleaning unit at a first axial position separate from a nozzle unit at a second axial position;

activating the cleaning unit to clean a surface of the joint member using a cleaning fluid when the joint member reaches the first axial position;

rotating the nozzle unit to spray a lubricant onto the surface of the joint member when the joint member reaches the second axial position; and withdrawing the joint member from the housing.

22. A method according to claim 21, wherein the housing additionally contains a drying unit, and the cleaning unit cleans the joint member using cleaning fluid, the method further comprising activating the drying unit to dry the joint member.

23. A method according to claim 21, wherein said housing is fixed to a well plafform at an end opposed to said end having the opening therein, and said step of inserting the joint member into said opening comprises remotely positioning said tubular above the opening in the housing, and lowering the tubular so that the joint member of the tubular enters the housing through the opening.

24. A method according to claim 21, wherein said housing is fixed to a robotic arm at an end opposed to said end having the opening therein, and said step of inserting the joint member into said opening comprises remotely positioning the housing above the joint member to be cleaned and doped, and lowering the housing so that the joint member of the tubular enters the housing through the opening.

25. The method of claim 21, wherein activating the cleaning unit comprises causing two sets of gas jets to be directed onto a surface region of the joint member from substantially opposite directions so as to clean the surface of the joint member.

26. Apparatus for doping a joint member of a tubular, the apparatus comprising:

a nozzle unit rotatable about a longitudinal axis, the nozzle unit positioned at a first axial location in the apparatus and the nozzle unit comprising an array of interspersed gas and lubricant nozzles coupled respectively to a source of pressurised gas and a source of lubricant such that in use lubricant ejected from the lubricant nozzles is sprayed onto the joint member to be doped and energized by a force applied by gas ejected from the gas nozzles; and a cleaning unit positioned at a second axial location in the apparatus, the cleaning unit having two respective axially spaced rings, each of which comprises a multiplicity of radially spaced nozzles or openings, a first of these rings being coupled to a source of cleaning liguid whilst a second is coupled to a source of drying gas wherein the first axial location is separate from the second axial location.

27. Apparatus according to claim 26, wherein the gas and lubricant nozzles are arranged substantially on a common plane.

28. Apparatus according to claim 26, wherein the gas nozzles are located in a common plane, behind a line of lubricant nozzles.

29. Apparatus according to claim 26, wherein the array of interspersed gas and lubricant nozzles is an elongate array having its axis substantially aligned with the axis of housing.

30. Apparatus according to claim 29, wherein a length of the nozzle array is substantially the same as, or exceeds that of, the joint member to be doped.

31. The apparatus of claim 26, wherein the lubricant is energized comprises accelerating or atomizing the lubricant.

32. Apparatus for cleaning and doping a joint member of a tubular on a well platform, the apparatus comprising:

a housing having first and second opposed ends, said second end having an opening therein for receiving the joint member to be cleaned and doped, said housing being mounted to a movable arm connected to the well platform;

a nozzle unit mounted in or to the housing at a first axial position for rotation about a longitudinal axis of the housing and coupled to a source of lubricant; and a cleaning unit mounted in or to the housing at a second axial position and coupled to a source of cleaning fluid, wherein the first axial position is separate from the second axial position, wherein the nozzle unit is directed at a surface cleaned by the cleaning unit.

33. Apparatus according to claim 32, wherein the cleaning unit comprises two respective axially spaced rings, each of which comprises a multiplicity of radially spaced nozzles or openings, a first of these rings being coupled to a source of cleaning liquid whilst a second is coupled to a source of drying gas.

34. A method for cleaning and doping a joint member of a tubular on a well platform, the method comprising:

mounting a housing to an extendable arm connected to the well platform, the housing having a cleaning unit at a first axial position separate from a nozzle unit at a second axial position;

inserting the joint member into an opening in an end of the housing;

activating the cleaning unit to clean the joint member using a cleaning fluid when the joint member is positioned proximate the first axial position;

activating the nozzle unit to spray a lubricant onto a surface of the joint member when the joint member is positioned proximate the second axial position; and withdrawing the joint member from the housing.

35. A method according to claim 34, further comprising activating a drying unit to dry the joint member.

* * * * *

UNITED STATES PATENT AND TRADEMARK OFFICE

CERTIFICATE OF CORRECTION

PATENT NO. : 7,371,289 B2
APPLICATION NO. : 10/333763
DATED : May 13, 2008
INVENTOR(S) : Reinholdt et al.

It is certified that error appears in the above-identified patent and that said Letters Patent is hereby corrected as shown below:

In the Abstract (57):

Line 4, please delete “conosed” and insert --opposed-- therefor;

In the Claims:

Column 8, Claim 23, Line 58, please delete “plafform” and insert --platform-- therefor;

Column 9, Claim 26, Line 25, please delete “liguid” and insert --liquid-- therefor;

Column 9, Claim 29, Line 36, please insert --a-- after of.

Signed and Sealed this

Tenth Day of February, 2009

JOHN DOLL
*Acting Director of the United States Patent and Trademark Office*